US007140375B2

(12) United States Patent
Norris

(10) Patent No.: US 7,140,375 B2
(45) Date of Patent: Nov. 28, 2006

(54) COVER SUPPORT DEVICE FOR POLE

(76) Inventor: Mark Norris, 4764 Dusty's Rd., Akron, OH (US) 44319

( * ) Notice: Subject to any disclaimer, the term of this patent is extended or adjusted under 35 U.S.C. 154(b) by 86 days.

(21) Appl. No.: 10/390,848

(22) Filed: Mar. 18, 2003

(65) Prior Publication Data

US 2003/0172965 A1 Sep. 18, 2003

Related U.S. Application Data

(60) Provisional application No. 60/365,501, filed on Mar. 18, 2002.

(51) Int. Cl.
*E04H 15/64* (2006.01)
*E04H 15/26* (2006.01)

(52) U.S. Cl. ..... 135/119; 135/99; 135/100

(58) Field of Classification Search ..... 135/119, 135/99, 33.2, 19, 90, 100
See application file for complete search history.

(56) References Cited

U.S. PATENT DOCUMENTS

| | | | | | |
|---|---|---|---|---|---|
| 344,488 | A | | 6/1886 | McKenzie | |
| 644,737 | A | | 3/1900 | Fry | |
| 851,429 | A | * | 4/1907 | Noble | 135/90 |
| 1,249,883 | A | * | 12/1917 | Baldwin | 135/94 |
| 1,428,343 | A | * | 9/1922 | Runcie | 135/93 |
| 1,610,801 | A | * | 12/1926 | McKinnon | 135/120.3 |
| 1,669,611 | A | * | 5/1928 | Goldberg | 135/114 |
| 1,912,564 | A | | 6/1933 | Benson et al. | |
| 1,995,489 | A | * | 3/1935 | Valasck | 135/120.3 |
| 2,474,516 | A | | 6/1949 | Daniel | |
| 2,601,865 | A | * | 7/1952 | Campbell | 135/92 |
| 3,106,931 | A | | 10/1963 | Cooper | |
| 3,498,305 | A | * | 3/1970 | Hulin | 135/90 |
| 3,545,461 | A | * | 12/1970 | Carlson | 135/90 |
| 3,896,830 | A | * | 7/1975 | Sharick | 135/93 |
| 3,952,463 | A | | 4/1976 | Lane | |
| 4,038,997 | A | | 8/1977 | Smith | |
| 4,148,332 | A | * | 4/1979 | Huddle | 135/123 |
| 4,305,171 | A | | 12/1981 | Pettersson | |
| 4,340,075 | A | * | 7/1982 | Medeiros | 135/120.1 |
| 4,505,285 | A | * | 3/1985 | French | 135/33.7 |
| 4,677,796 | A | * | 7/1987 | Mellott | 52/73 |
| 4,927,109 | A | * | 5/1990 | Wilson | 248/354.3 |
| 4,979,457 | A | | 12/1990 | Sommerhauser et al. | |
| 5,222,988 | A | | 6/1993 | Riley | |
| 5,477,876 | A | | 12/1995 | Moss | |
| 5,479,872 | A | | 1/1996 | Hulett | |
| 5,918,614 | A | * | 7/1999 | Lynch | 135/95 |
| 6,047,441 | A | | 4/2000 | Moorman | |
| 6,124,017 | A | | 9/2000 | Sokol, Jr. et al. | |
| 6,308,653 | B1 | | 10/2001 | Geraci | |

(Continued)

*Primary Examiner*—Anita M. King
(74) *Attorney, Agent, or Firm*—Fay, Sharpe, Fagan, Minnich & McKee, LLP

(57) ABSTRACT

A support device for an associated cover member includes a hub defining a bore adapted to receive a tip of an associated support pole. A shell projects radially outwardly from the hub. The shell defines an outer surface adapted to support an associated cover member. In use, the device is installed on a tip of a support pole so that an end portion of the tip projects through the support device. The projecting end portion of the pole tip is inserted into a grommet or eyelet of a cover to be supported. The pole is positioned so that the cover is supported on the outer surface of the shell. The device can have an overall frusto-conical shape.

9 Claims, 2 Drawing Sheets

U.S. PATENT DOCUMENTS 6,328,049 B1 12/2001 Kim
6,338,356 B1 * 1/2002 Wallenstatter ..... 135/100
D454,609 S * 3/2002 Meyerhoffer et al. ..... D21/839
6,418,952 B1 7/2002 Worley et al.
6,431,193 B1 8/2002 Carter
6,511,121 B1 1/2003 Cochran et al.

* cited by examiner

COVER SUPPORT DEVICE FOR POLE

CROSS-REFERENCE TO RELATED APPLICATION

This application claims benefit of the filing date and priority from U.S. provisional application Ser. No. 60/365,501 filed Mar. 18, 2002.

BACKGROUND OF THE INVENTION

The present invention relates to a device used with an associated pole for supporting a cover or tarp made from canvas, plastic or another material. It is well-known to support a canvas boat cover or the like with one or more poles. In a conventional arrangement, an eyelet or grommet is used to define a small opening in the canvas, and the tip of a pole is inserted through the grommet from the underside. Over time, however, the interface between the canvas and the grommet is weakened and will eventually tear. This tearing is often caused or encouraged by the presence of water, ice and snow or leaves on the canvas and/or by wind.

In light of the foregoing, a need has been found for a simple, effective and low-cost device for supporting a cover at and adjacent the interface between the cover and a support pole.

SUMMARY OF THE INVENTION

In accordance with a first aspect of the present invention, a support device for an associated cover member comprises a hub defining a bore adapted to receive a tip of an associated support pole. A shell projects radially outwardly from the hub. The shell defines an outer surface adapted to support an associated cover member.

In accordance with another aspect of the present invention, a method of supporting a cover comprises installing a support device on a tip of a support pole so that an end portion of the tip projects through the support device. The support device comprises a hub defining a bore adapted to receive the tip of the support pole and a shell that projects radially outwardly from the hub. The shell defines an outer surface adapted to support an associated cover member. The method further includes inserting the projecting end portion of the pole tip into a grommet or eyelet of a cover. The pole is positioned so that the cover is supported on the outer surface of the shell.

DETAILED DESCRIPTION OF PREFERRED EMBODIMENTS

A canvas support device formed in accordance with the present invention is shown at 10 in FIGS. 1–4. The device 10 is preferably a one-piece construction of molded polymeric material, i.e., plastic, but can be assembled or otherwise formed from multiple separate components of any desired material such as metal if desired. The one-piece molded plastic construction provides a low-cost, lightweight and durable design.

The device 10 comprises an outer shell 12 that extends radially outwardly from a central hub 14. The shell preferably defines a circular periphery 12*p* that lacks corners or sharp edges as could tear an associated canvas or other cover member. The shell 12 comprises an outer surface 12*a* that is preferably smooth so as not to damage any cover in contact therewith as described below.

Figure 1:
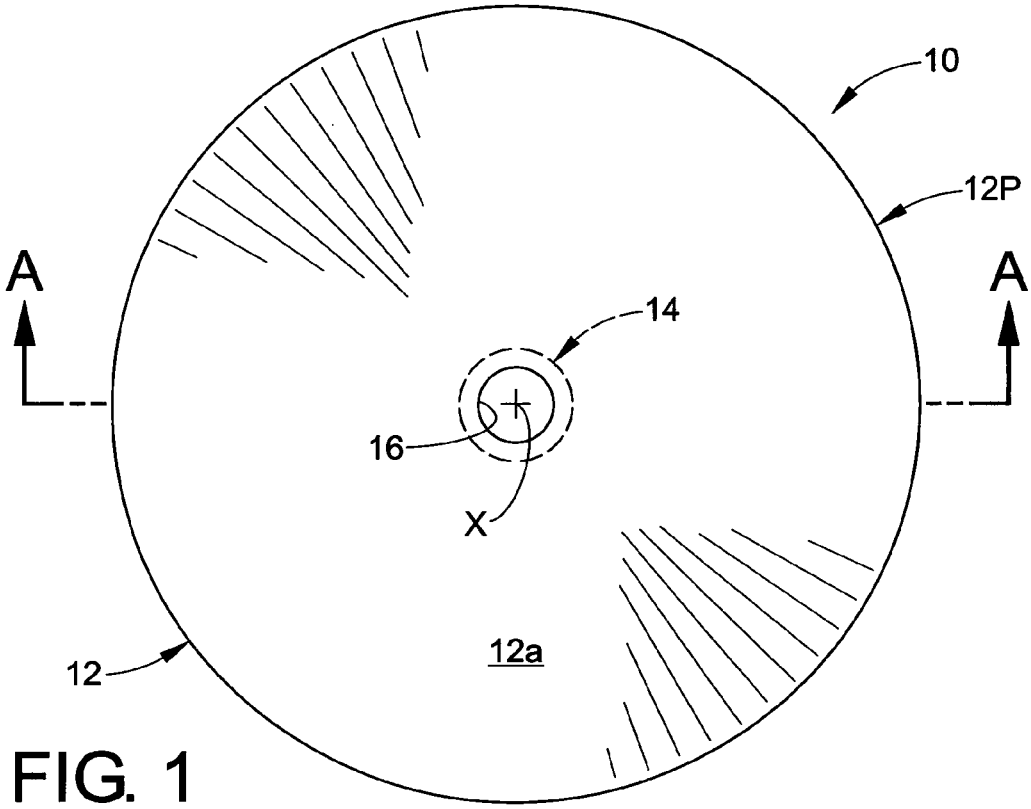
FIG. 1 is a top plan view of a canvas support device formed in accordance with the present invention.
Figure 2:
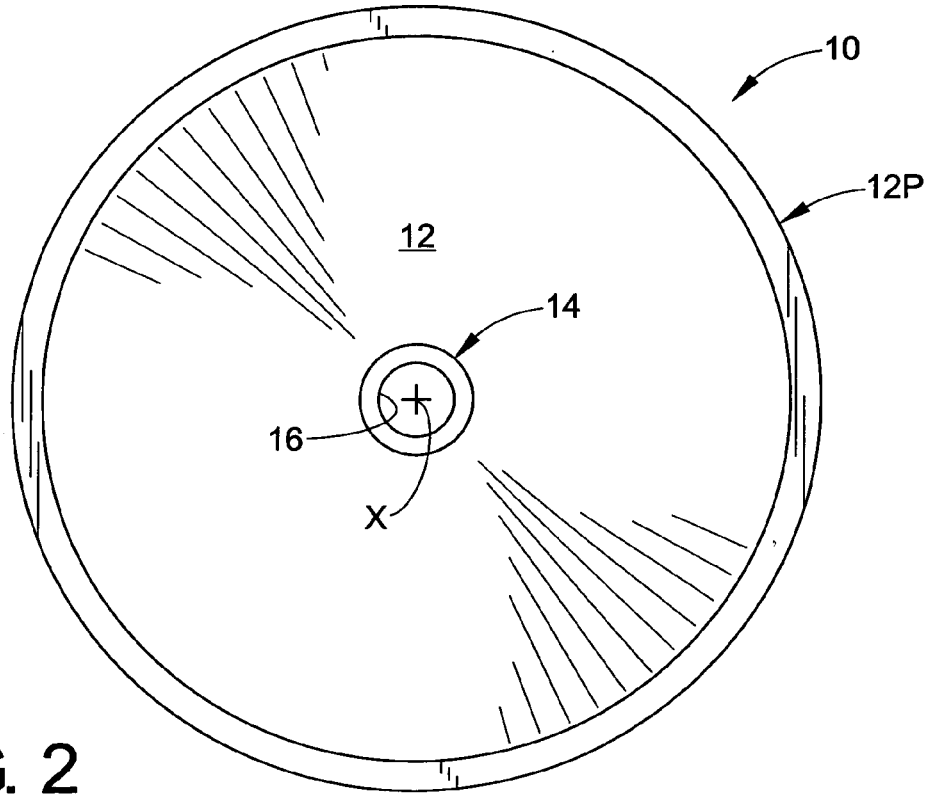
FIG. 2 is a bottom view of a canvas support device formed in accordance with the present invention.
Figure 3:
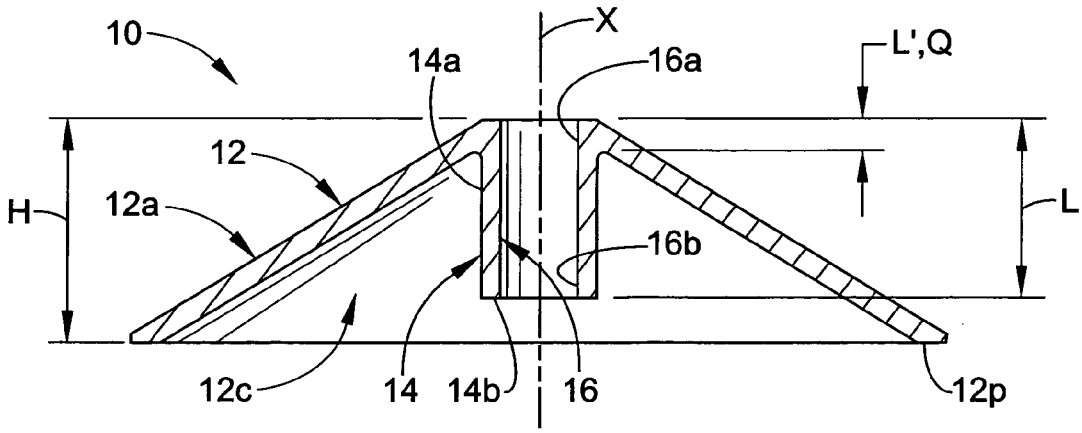
FIG. 3 is a sectional view taken along lines A—A of FIG. 1.
Figure 4:
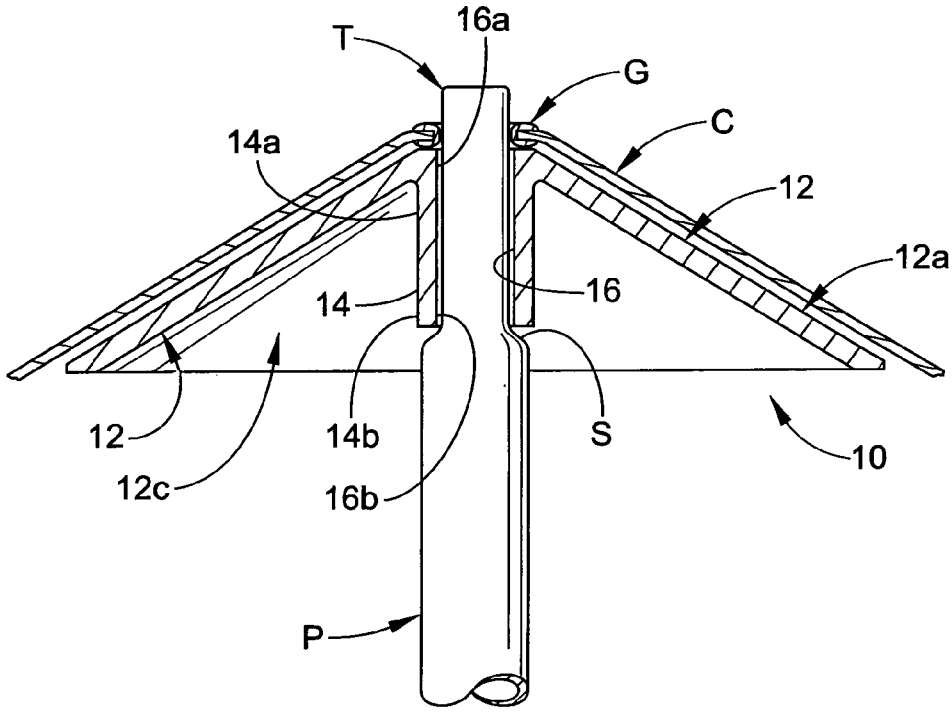
FIG. 4 is a sectional view similar to FIG. 2, but shows the canvas support device in use.

As shown in FIGS. 3 and 4, the central hub 14 includes a first end 14*a* and a second end 14*b*. The hub 14 defines a through-bore 16 (preferably cylindrical) conformed and dimensioned for sliding receipt of a tip T of an associated pole P (FIG. 4). The bore 16 extends along an axis X. The bore 16 includes a first end 16*a* that opens centrally through the shell 12 and a second end 16*b* that opens in the second end 14*b* of the hub 14.

In the illustrated preferred embodiment, the hub portion 14 is cylindrical and the outer shell 12 defines a conical shape. The device 10 defines an overall frusto-conical shape. As noted in FIG. 4, the outer shell 12 preferably extends radially outward and downwardly away from the first end 14*a* of the hub portion 14 (axially toward second end 14*b* of hub 14) at an angle of 10°–50° (e.g., about 30° as shown) relative to the axis X, although this angle may vary, so that the hub 14 is found in the concave recessed portion 12*c* of the shell 12, i.e., the hub 14 projects outwardly from the shell 12 on the side opposite the support surface 12*a*.

As illustrated in FIG. 4, the bore 16 closely slidably receives a reduced-diameter tip portion T of the associated support pole P so that an end portion of the tip T projects entirely through the bore 16 and outwardly beyond the shell 12. The second end 14*b* of the hub portion 14 engages a shoulder S of the pole P when the device 10 is fully operatively installed on the pole P to prevent further insertion of the tip T into bore 16. It is preferred but not absolutely required that the hub 14 and bore 16 defined therein be sufficiently long so that, when the tip T is closely received in the bore 16, the axis X of the bore 16 stays aligned (co-axial) with the pole. In one embodiment, the hub 14 preferably has a length L (FIG. 3) of at least 0.5 inches and most preferably at least 0.75 inches, but less than an overall height H of the device 10. The overall height H of the device 10 is measured as the largest dimension that the device extends along the axis X. In an alternative embodiment, the hub 14 can have a minimal length L' so as not to project outwardly from the shell 12, i.e., the hub 14 has a length L' no greater than the thickness Q of the shell 12 adjacent bore 16.

In use as shown in FIG. 4, the end portion of the tip T that extends through the bore 16 beyond the shell 12 is received through a grommet or eyelet G of an associated canvas cover C or the like so that the portion of the cover C adjacent the grommet G is supported directly on convex outer surface 12*a* of the shell 12 of the device 10. In this manner, the weight of the cover C and any snow, ice, water, or other objects located on the cover C is evenly distributed over the entire outer surface 12*a* of shell 12 and transferred to pole P via the hub 14 without being concentrated at the interface between the cover C and the grommet G.

Modifications will occur to those of ordinary skill in the art. It is intended that the invention be construed as encompassing all such modifications and alterations.

What is claimed is:

1. A support device for temporary and releasable support of an associated cover member having a grommet-reinforced opening therein, said support device comprising:

a molded polymeric hub having first and second opposite ends and defining a bore adapted to receive and closely surround a tip of an associated support pole to maintain coaxial alignment of said hub with an associated pole tip inserted in said bore, wherein said bore is adapted for releasable axial sliding engagement with the associated pole tip;

a molded polymeric shell projecting radially outwardly from and defined as a one-piece construction with said hub, said shell defining an outer surface including an inclined portion adapted to support an associated cover member and a concave inner surface, wherein said hub projects outwardly from said concave inner surface;

wherein said bore defined by said hub comprises: (i) a first end that opens through said first end of said hub and also through said outer surface of said shell to accommodate projection of the associated pole tip therethrough; and, (ii) an opposite second end that opens through the second end of said hub.

2. The device as set forth in claim 1, wherein said outer surface of said shell is inclined relative to said hub by an angle in the range of 10°–50°.

3. The device as set forth in claim 1, wherein said inclined outer surface of said shell Is conical and wherein said device defines an overall frusto-conical shape.

4. The device as set forth in claim 1, wherein said shell defines a circular periphery.

5. The device as set forth in claim 1, wherein said hub defines a length that is less than an overall height of the device so that said hub is entirely located within a recess formed by said shell.

6. The device as set forth in claim 1, wherein said hub defines a length of at least 0.5 Inches.

7. The device as set forth in claim 1, wherein said outer surface is smooth.

8. A method of supporting a cover that includes a grommet-reinforced opening therein, said method comprising:

releasably installing a support device on a tip of a support pole, said support device comprising: (I) an elongated, molded polymeric hub defining a bore adapted to receive The tip of the support pole; and, (ii) a shell defined as a one-piece molded polymeric construction with said hub, said shell projecting radially outwardly from said hub, said shell defining an outer surface adapted to support the cover, wherein said bore of said hub opens through said shell and wherein said step of releasably installing said support device comprises inserting said tip of said support pole into said bore and sliding said hub axially onto said tip until an end portion of said tip is exposed and projects outwardly from an outer surface of said shell on a side of said shell opposite said hub, said hub closely surrounding said tip to prevent said hub from moving out of axial alignment with said tip of said support pole;

inserting said exposed, projecting end portion of said tip into a grommet-reinforced opening of the cover so that said grommet and said cover are seated on said outer surface of said shell; and, positioning said pole so that said cover is supported on said outer surface of said shell.

9. The method as set forth in claim 8, wherein said step of installing a support device on a tip of a support pole comprises inserting said tip into said bore defined by said hub and abutting said hub with a shoulder of said pole.

* * * * *